US012414613B1

(12) United States Patent
Lu

(10) Patent No.: US 12,414,613 B1
(45) Date of Patent: Sep. 16, 2025

(54) DETACHABLE LINK FOR WATCH BANDS AND DETACHABLE WATCH BAND

(71) Applicant: Shenzhen Qipurui Technology Co., Ltd., Shenzhen (CN)

(72) Inventor: Haibing Lu, Shenzhen (CN)

(73) Assignee: Shenzhen Qipurui Technology Co., Ltd., Shenzhen (CN)

( * ) Notice: Subject to any disclaimer, the term of this patent is extended or adjusted under 35 U.S.C. 154(b) by 0 days.

(21) Appl. No.: 19/072,051

(22) Filed: Mar. 6, 2025

(30) Foreign Application Priority Data

Feb. 21, 2025 (CN) ..... 202520290972.2

(51) Int. Cl.
*A44C 5/02* (2006.01)
*A44C 5/10* (2006.01)

(52) U.S. Cl.
CPC ..... *A44C 5/107* (2013.01)

(58) Field of Classification Search
CPC ..... F16G 15/04; F16G 15/06; F16G 15/12; G04B 37/1486; G04B 37/18; G04B 37/1493; G04B 37/16; Y10T 24/4782; Y10T 24/47; Y10T 24/4718; A44C 5/02; A44C 5/105; A44C 5/14; A44C 15/0025; A44C 5/10; A44C 5/107
USPC ..... 368/282; 59/85; 224/164
See application file for complete search history.

(56) References Cited

U.S. PATENT DOCUMENTS

| | | | | |
|---|---|---|---|---|
| 5,483,505 | A * | 1/1996 | Cartier | G04B 37/1493 368/282 |
| 7,946,103 | B2 * | 5/2011 | So | A44C 5/102 63/4 |
| 8,281,616 | B2 * | 10/2012 | Bergundthal | A44C 5/105 63/38 |
| 11,583,042 | B2 * | 2/2023 | Lachat | A44C 5/02 |
| 2001/0022073 | A1 * | 9/2001 | Vandini | A44C 5/107 59/82 |

FOREIGN PATENT DOCUMENTS

| | | | | |
|---|---|---|---|---|
| CH | 703096 | A2 * | 11/2011 | A44C 5/107 |
| CH | 717993 | A2 * | 4/2022 | A44C 5/107 |
| CN | 205106612 | U | 3/2016 | |
| CN | 213882029 | U | 8/2021 | |
| CN | 221130735 | U | 6/2024 | |

* cited by examiner

*Primary Examiner* — Jack W Lavinder
(74) *Attorney, Agent, or Firm* — Nitin Kaushik

(57) ABSTRACT

The present application relates to a detachable link for watch bands and a detachable watch band. The detachable link comprises an I-piece, a middle link, spring bars, and a key. By improving the connection mode between the watch band links, users are allowed to quickly take off or put in a watch band link without tools, thereby realizing length adjustment.

9 Claims, 8 Drawing Sheets

DETACHABLE LINK FOR WATCH BANDS AND DETACHABLE WATCH BAND

CROSS-REFERENCE TO RELATED APPLICATIONS

The application claims priority to Chinese patent application No. 202520290972.2, filed on Feb. 21, 2025, the entire contents of which are incorporated herein by reference.

TECHNICAL FIELD

The present application relates to the field of mechanical technology, in particular to a detachable link for watch bands and a detachable watch band.

BACKGROUND

With the continuous improvement of people's requirements for comfort and aesthetics when wearing a wristwatch, the design of watch bands goes much more diversified. Sizes of wrists vary from user to user, and users need to adjust the length of a watch band themselves or re-tune it after wearing for a period of time. At present, most metal watch bands on the market require external tools to adjust their length. For example, it is necessary to use a special watch adjuster and disassembly tool to remove and reassemble the connecting pin of a watch band. Such a watch band length adjusting method is inconvenient to operate, requires special tools, and in the adjusting, it is easy to damage the watch band or connecting pin, which usually needs professionals to deal with, increasing time cost and economic cost. Therefore, how to realize the rapid disassembly and length adjusting of a watch band without using special tools has become an urgent technical problem in related fields.

SUMMARY

The technical problem to be solved by embodiments of the present application is to provide a detachable link for watch bands and a detachable watch band, so that users can quickly remove or adjust the length of a watch band without external tools, thereby improving wearing comfort and convenience.

In order to solve the above problem, an embodiment of the present application provides a detachable link for watch bands in one aspect, comprising:

an I-piece, comprising a first beam, a second beam and a third beam connecting the first beam and the second beam, and the first beam, the second beam and the third beam forming a first recess and a second recess at both sides of the third beam, wherein the first recess is configured to receive a middle link of an adjacent detachable link, an inner wall of the first recess is provided with a spring bar hole and a chute, and the second recess is configured to receive a middle link of the detachable link itself; a middle link, having a first spring bar passage and a second spring bar passage run-through; spring bars, disposed in the first spring bar passage and the second spring bar passage and elastically stretchable along a length direction thereof; and a key, for quickly releasing the connection between the I-piece and the middle link of the adjacent detachable link.

In another aspect, an embodiment of the present application provides a detachable watch band comprising the above-mentioned detachable link.

In another aspect, an embodiment of the present application provides a wristwatch comprising a dial and a watch band, and the watch band comprises the detachable link.

Compared with the prior art, the technical solutions in embodiments of the present application have the following advantages:

in terms of the detachable link for watch bands and the detachable watch band provided in embodiments of the present application, the watch band links can be quickly removed or connected without external tools, thereby adjusting the length of the watch band, and a user can adjust the length of the watch band at home. The detachable link for watch bands and the detachable watch band provided in embodiments of the present application improve the convenience of adjusting the length of the watch band, while avoiding damage to the watch band or the connecting pin during the adjustment.

BRIEF DESCRIPTION OF DRAWINGS

To illustrate technical solutions in embodiments of the present application or the prior art more clearly, accompanying drawings to be used for describing the embodiments or prior art are introduced briefly in the following. Apparently, the accompanying drawings in the following description are only embodiments of the present application, and persons of ordinary skill in the art can derive other drawings from the drawings provided without creative efforts.

Figure 1:
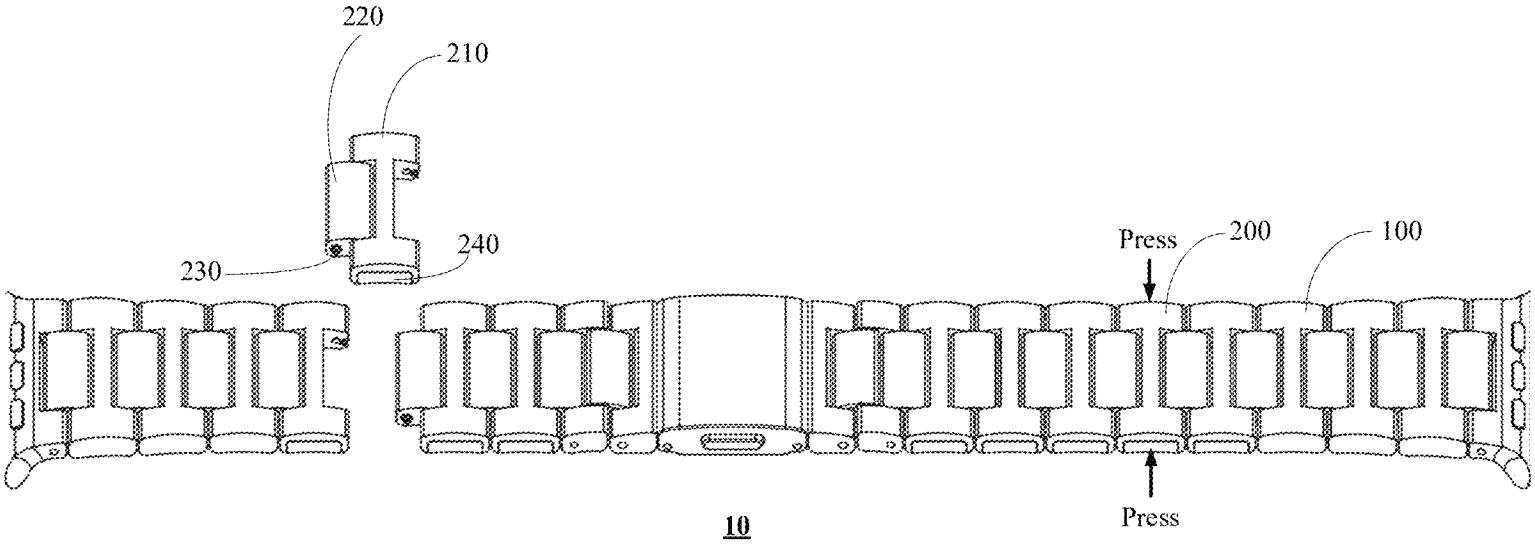
FIG. 1 is a structural schematic diagram of a detachable watch band according to an embodiment of the present application.

In the figure, there are detachable watch band 10, regular link 100, detachable link 200, I-piece 210, first beam 211, second beam 212, third beam 213, first recess 214, second recess 215, spring bar hole 216, chute 217, key slot 218, key connecting hole 219, middle link 220, first spring bar passage 221, second spring bar passage 222, spring bar 230, telescopic end 231, key 240, first bulge 241, second bulge 242, I-piece connecting hole 243, spring 244 and bolt 245.

DETAILED DESCRIPTION OF THE EMBODIMENTS

In order to make the objectives, technical solutions and advantages of the present disclosure more clear, the present disclosure will be further described in detail below with reference to the drawings. Obviously, the embodiments described are only some, not all, of the embodiments of the present disclosure. Based on the embodiments described herein, all other embodiments obtained by those of ordinary skill in the art without creative efforts shall fall within the protection scope of the present disclosure.

The terminology used in the disclosed embodiments is for purposes of describing particular embodiments only and not intended to limit the present disclosure. The singular forms of "a", "the" and "this" as used in embodiments of the present disclosure and the appended claims are also intended to include the plurality of forms, unless the context clearly indicates other meanings, "multiple" generally includes at least two.

It should be understood that the term "and/or" as used in this document is only an association relationship describing associated objects, indicating that three relationships can exist, e.g., A and/or B, which may indicate that there are three cases: A alone, both A and B, and B alone. In addition, the character "/" in this document generally indicates that the context-related object is an "or" relationship.

It should be understood that although the terms first, second, third, etc. may be used to describe in embodiments of the present disclosure, these should not be limited to these terms. These terms are used only to differentiate. For example, the first may also be referred to as a second without departing from the scope of embodiments of the present disclosure, and similarly, the second may also be referred to as a first.

It should also be clarified that the terms "comprising", "comprises" or any other variation thereof are intended to cover non-exclusive inclusion, so that a commodity or installation comprising a list of elements includes not only those elements but also other elements not expressly listed therein, or elements inherent in such commodity or installation. Without further limitation, an element qualified by the phrase "comprising a" does not preclude the presence of additional identical elements in the commodity or installation that include such an element.

It can be known from the background art that, in the process of adjusting the length of the existing watch band, it is often necessary to disassemble and reassemble with the help of external tools, which is not only cumbersome to operate, but also easy to damage the watch band and its connecting parts.

In order to solve the above technical problem, an embodiment of the present application provides a detachable link for watch bands, comprising an I-piece, comprising a first beam, a second beam and a third beam connecting the first beam and the second beam, and the first beam, the second beam and the third beam forming a first recess and a second recess at both sides of the third beam, wherein the first recess is configured to receive a middle link of an adjacent detachable link, an inner wall of the first recess is provided with a spring bar hole and a chute, and the second recess is configured to receive a middle link of the detachable link itself; a middle link, having a first spring bar passage and a second spring bar passage run-through; spring bars, disposed in the first spring bar passage and the second spring bar passage and elastically stretchable along a length direction thereof; and a key, for quickly releasing the connection between the I-piece and the middle link of the adjacent detachable link.

With the detachable link for watch bands provided in this embodiment and by improving the connection mode between the watch band links, users are allowed to quickly take off or put in a watch band link without tools, thereby realizing length adjustment.

In order to make the above objectives, features, and advantages of the present application more obvious and understandable, specific embodiments of the present application will be described in detail with reference to the drawings below.

Figure 2:
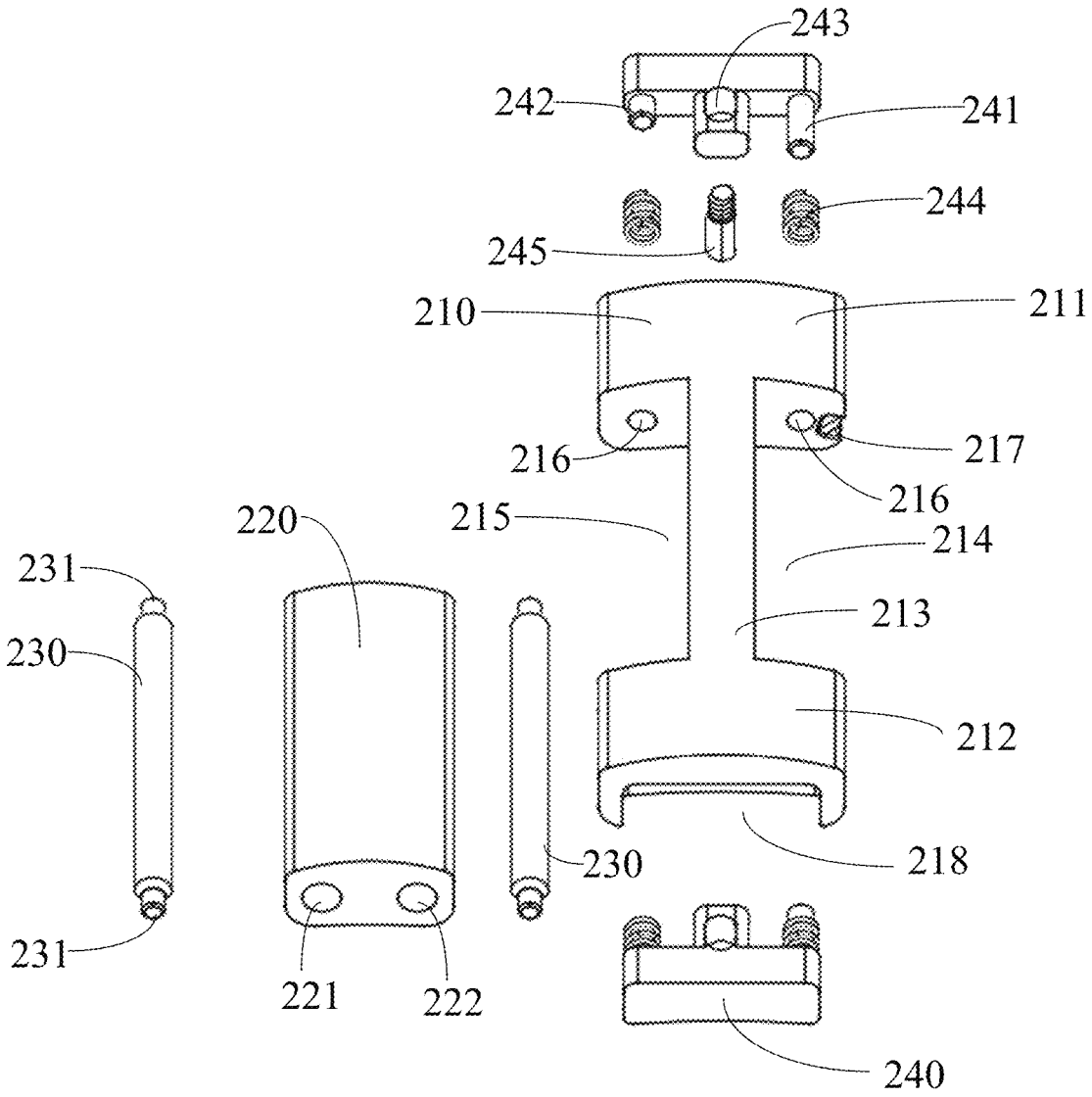
FIG. 2 is a structural schematic diagram of a detachable link in a front view according to an embodiment of the present application.
Figure 3:
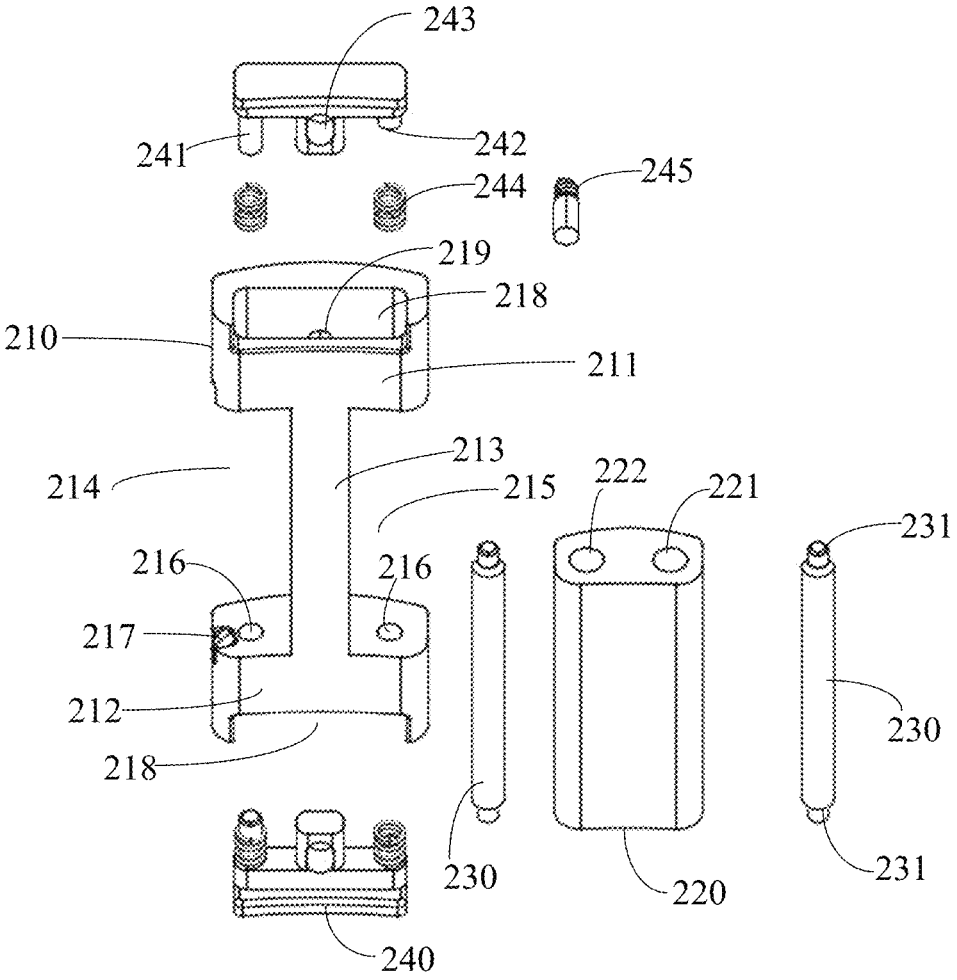
FIG. 3 is a structural schematic diagram of a detachable link in a back view according to an embodiment of the present application.

FIGS. 1 to 3 are structural schematic diagrams of a detachable link 200 and a detachable watch band 10 using the detachable link 200 in accordance with the present disclosure.

Referring to FIG. 1, the detachable watch band 10 includes a plurality of watch band links connected with each other, and at least one detachable link 200 is included in the plurality of watch band links. As a specific example, the detachable watch band 10 shown in FIG. 1 includes two kinds of watch band links, namely, regular link 100 and detachable link 200. The regular link 100 is a watch band link unit of a regular structure, and two adjacent regular links 100 need to be detached by an external tool. The detachable link 200 is a watch band link unit with a special structure, which can be quickly disassembled and assembled without external tools, so as to achieve the purpose of quickly adjusting the length of the watch band.

FIG. 1 shows a detachable watch band 10 and a detachable link 200 detached from the detachable watch band 10. The number of the detachable links 200 in the detachable watch band 10 can be one or more, and when a user needs to finely adjust the length of the watch band, it is only necessary to remove or add a corresponding number of the detachable links 200. It can be understood that the number and specific structure of the regular links 100 are not limited, and in some embodiments, the detachable watch band 10 does not include the regular links 100.

The detachable link 200 further comprises an I-piece 210, a middle link 220, spring bars (elastic connecting rods) 230 and a key 240.

In which, the I-piece 210 is similar to the letter 'I' in shape, and comprises a first beam 211 and a second beam 212, parallel to each other, and a third beam 213 connecting the first beam 211 and the second beam 212. The first beam 211 and the second beam 212 are parallel to each other, the third beam 213 is substantially perpendicularly connected between the first beam 211 and the second beam 212, and the first beam 211, the second beam 212, and the third beam 213 are mutually connected to form an integral body, so that the I-piece 210 is similar to the letter "I" in shape.

In the I-piece 210, the first beam 211, the second beam 212 and the third beam 213 enclose two recesses: a first recess 214 and a second recess 215. The first recess 214 and the second recess 215 are located on both sides of the third beam 213, respectively. In some embodiments, the first recess 214 and the second recess 215 are symmetrically disposed with respect to the third beam 213.

In which, the first recess 214 is configured to receive a middle link 220 of an adjacent watch band link, and an inner wall of the first recess 214 is further provided with a spring bar hole 216 and a chute 217; the chute 217 and the spring bar hole 216 are configured to define a moving path of the spring bar 230 so as to achieve rapid assembly and disassembly, in which, the spring bar hole 216 is configured to receive the spring bar 230 of the adjacent middle link and define a position of the spring bar 230, the chute 217 is configured to guide movement of the spring bar 230, and the spring bar 230 is thereby guided to slide into the spring bar hole 216.

In which, the second recess 215 is configured to receive the middle link 220 of the detachable link 200 itself, and an inner wall of the second recess 215 is provided with a spring bar hole 216 for receiving the spring bar 230 of the middle link of the detachable link 200 itself and defining a position of the spring bar 230.

In the first recess 214, a chute 217 and a corresponding spring bar hole 216 can be arranged on an inner side of the first beam 211 (i.e., a surface of the first beam 211 opposite to the second beam 212) and an inner side of the second beam 212 (i.e., a surface of the second beam 212 opposite to the first beam 211), respectively. The chute 217 generally extends along an insertion direction of the middle link 220, and the depth of the chute 217 gradually decreases in the insertion direction of the middle link 220, thereby guiding the length of the spring bar 230 inside the middle link 220 to be gradually shortened. After the middle link 220 is inserted into a final position, both ends of the spring bar 230 are aligned with the spring bar holes 216, and due to the elasticity of the spring bar 230, both ends of the spring bar 230 pop out outwardly and slide into the spring bar hole 216, forming a lock on the ends of the spring bar 230. In this embodiment, the chute 217 and the corresponding spring bar hole 216 fit with each other to ensure that the middle link 220 smoothly slides into the first recess 214, and at the same time, the spring bar 230 automatically rebounds at the position of the spring bar hole 216 to achieve position locking, so that the detachable link 200 can be installed without external tools.

The middle link 220 fits with the I-piece 210 and is located in a second recess 215 formed by its corresponding I-piece 210. The middle link 220 can be inserted into the first recess 214 of the other I-piece 210 by sliding when necessary to achieve connection between links, and the middle link 220 can be disengaged from the adjacent I-piece 210 by pressing the key 240 when necessary.

Spring bar passages are formed in the middle link 220 so that the spring bar 230 can pass through the middle link 220. Specifically, the spring bar passages comprise a first spring bar passage 221 and a second spring bar passage 222. The first spring bar passage 221 and the second spring bar passage 222 are disposed in parallel inside the middle link 220, and can be butted with the spring bar hole 216 of the I-piece 210 to form a run-through structure for receiving the spring bar 230. The length of the spring bar 230 is slightly longer than that of the spring bar passage, and both ends of the spring bar 230 are exposed outside the spring bar passage after being inserted into the spring bar passage.

The spring bar 230 is a rod-shaped structure, which can be elastically stretched along a length direction of the rod to meet fit requirements in the process of disassembling and assembling a watch band. The spring bar 230 may be a metal rod. One or both ends of the spring bar 230 can be provided with an elastic element, such as a spring, and the elastic element is capable of contracting or elongating along its own length of the spring bar 230. When the elastic element is not subjected to an external force, the spring bar 230 is in a maximum elongated state; and when the elastic element is squeezed by an external force, it retracts along its own length direction of the spring bar 230, so as to realize rapid assembly and disassembly of the detachable link 200.

The key 240 is configured to quickly release the connection between the I-piece 210 and an adjacent middle link 220. When the key 240 is pressed by a user, an end of the spring bar 230 is compressed and thereby disengaged from the spring bar hole 216 in the I-piece 210 to effect separation of the I-piece 210 from the adjacent middle link 220.

In some embodiments, the first beam 211 and the second beam 212 respectively define a key slot 218; the key 240 is disposed in the key slot 218 and can slide in the key slot 218. The key 240 further comprises a first bulge 241, a second bulge 242, an I-piece connecting hole 243, a spring 244 and a bolt 245, in which, the first bulge 241 is disposed in the spring bar hole 216 inside the first recess 214, the second bulge 242 is disposed in the spring bar hole 216 of the second recess 215, and the length of the first bulge 241 is greater than that of the second bulge 242.

When a user presses the key 240, the key 240 is forced to slide downwards, so that the first bulge 241 and the second bulge 242 in the spring bar hole 216 move towards the spring bar 230, respectively. During the pressing process, the first bulge 241 first forces an elastic end point of the spring bar 230 to retract, thereby disengaging the spring bar 230 from its original position and withdrawing it from the first recess 214 of the I-piece 210. Since the length of the second bulge 242 is smaller than that of the first bulge 241, the elastic end point of the corresponding spring bar 230 cannot be successfully forced to retract during the pressing process, so that the spring bar 230 corresponding to the second bulge 242 remains in its original state.

In some embodiments, a key connecting hole 219 is further provided in the key slot 218, and an I-piece connecting hole 243 configured to fit with the key connecting hole 219 is correspondingly provided in the key 240; the key connecting hole 219, the I-piece connecting hole 243 and the bolt 245 fit with each other so that the key 240 is fixed in the key slot 218 and slides relatively.

A spring 244 is further disposed between the first bulge 241 and the spring bar 230, and between the second bulge 242 and the spring bar 230; the function of the spring 244 is to provide an elastic restoring force so as to ensure that when the key 240 is released, the key 240 can automatically rebound and return to its original position.

In another aspect, the present application provides a detachable watch band comprising the above-mentioned detachable link.

In another aspect, the present application provides a wristwatch comprising a dial and a watch band, and the watch band comprises the detachable link.

Figure 4A:
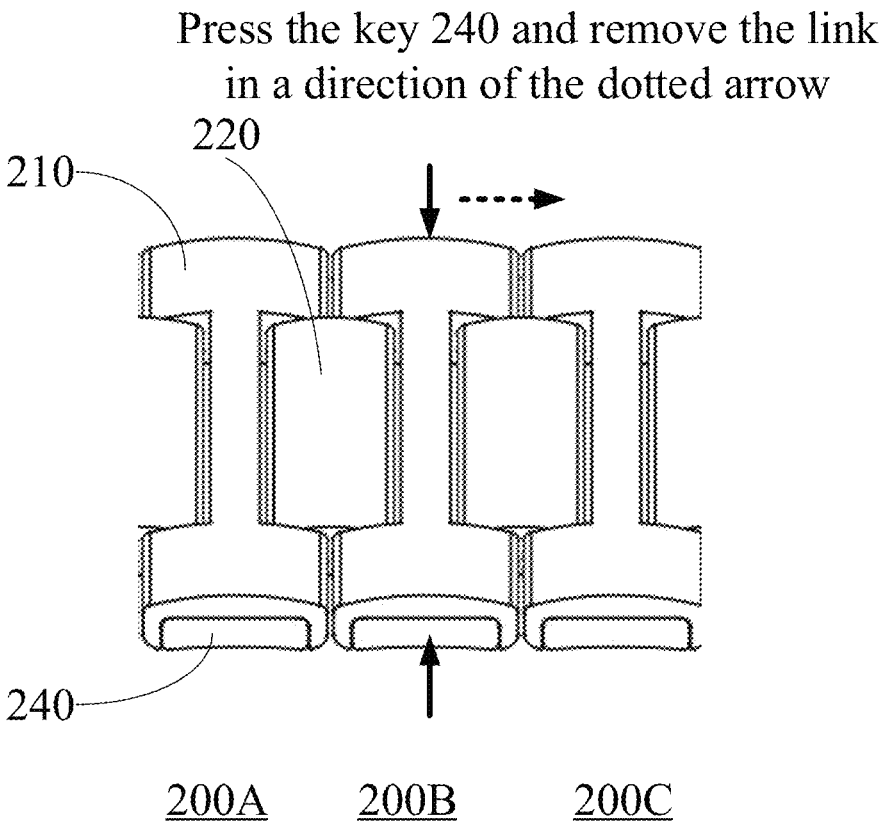
FIGS. 4A-4E are schematic diagrams illustrating length adjustment of a detachable watch band according to an embodiment of the present application.
Figure 4B:
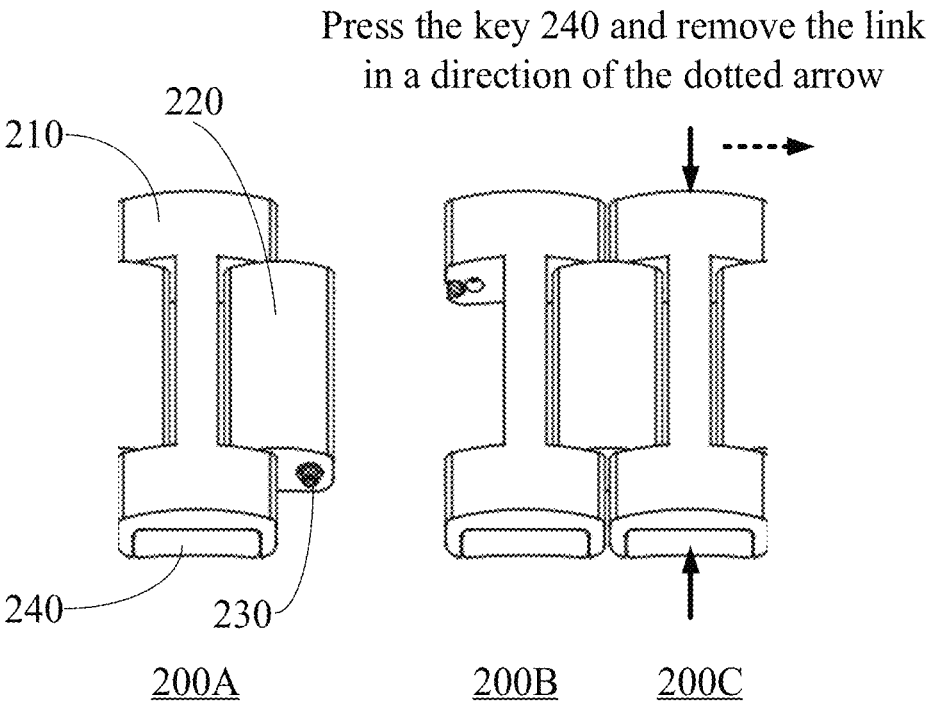
Figure 4C:
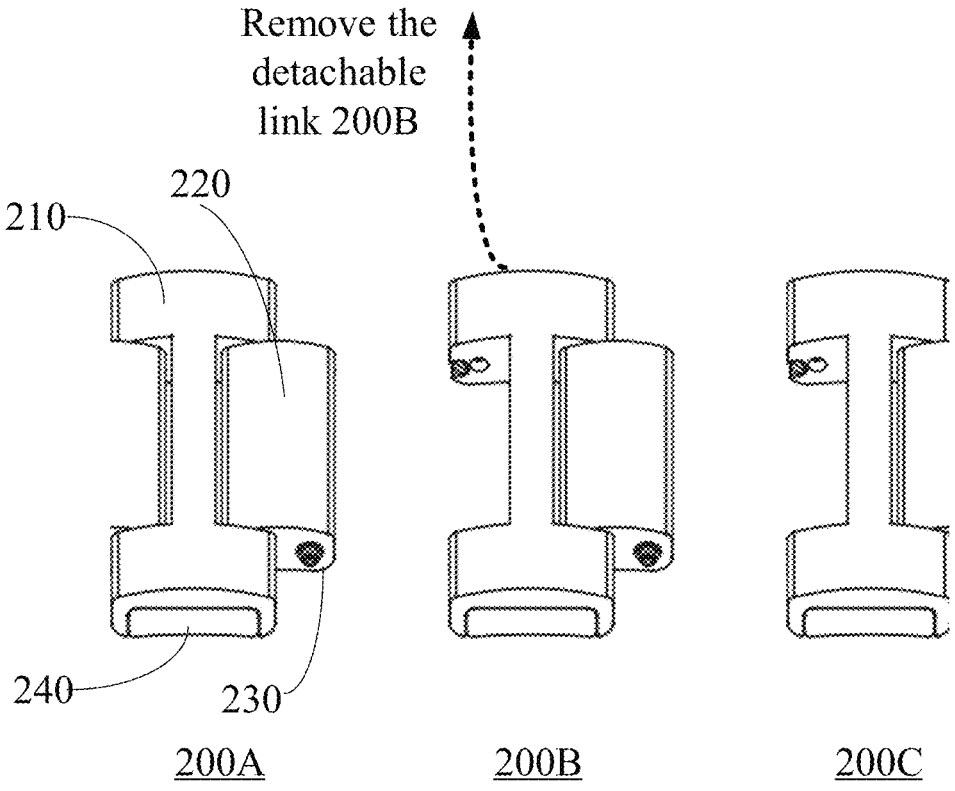
Figure 4D:
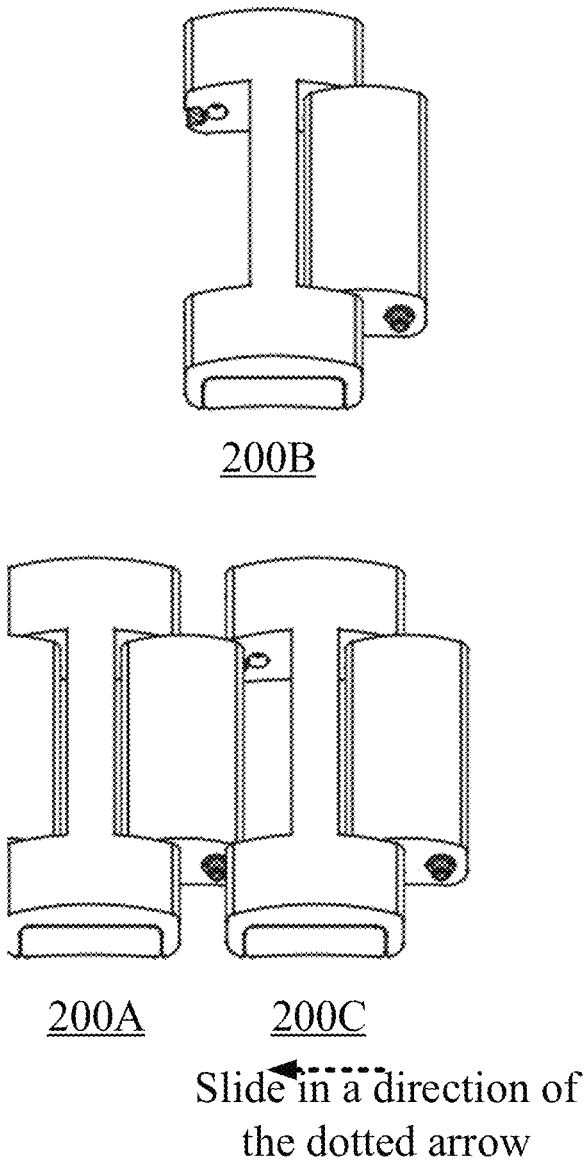
Figure 4E:
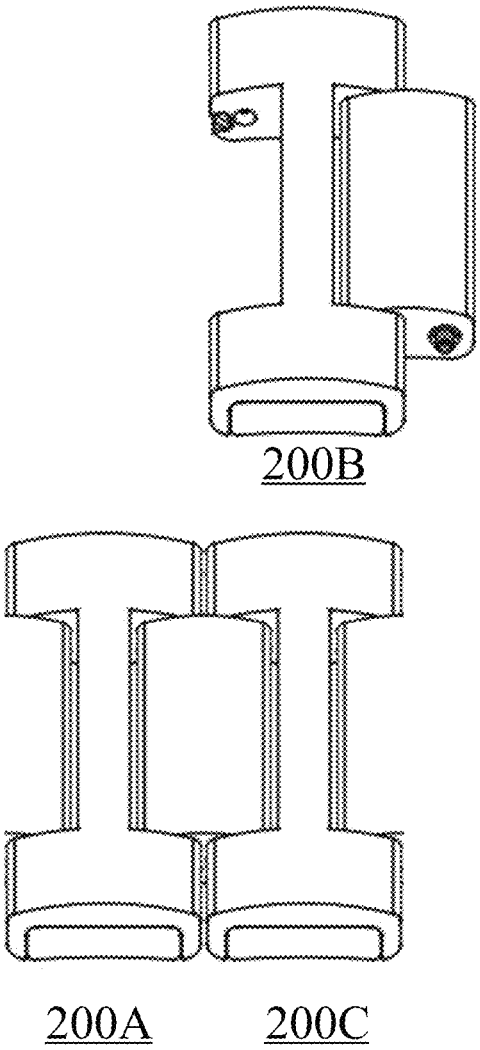

FIGS. 4A-4E illustrate a length adjusting process of the detachable watch band provided by this embodiment. In FIG. 4A, key 240 is in an unpressed initial state. At this state, watch band links 200A, 200B and 200C are connected to each other through components such as spring bars 230 and I-pieces 210. The watch band links are in a state of tight connection. When a user is ready to start adjusting the length of a watch band, the detachment process is initiated by pressing key 240. When key 240 of the watch band link 200B is pressed, both ends of the spring bar 230 begin to contract, thereby releasing the connection between link 200B and its adjacent link 200A. Link 200B begins to separate from the watch band and move outwardly under the action of key 240. In FIG. 4B, link 200B has been disengaged from its adjacent link 200A. Pressing key 240 of the link 200C releases the connection between link 200C and its adjacent link 200B. FIG. 4C shows a state in which link 200B is completely detached and taken out from the watch band. In FIG. 4D, link 200B has been completely removed from between the watch band links 200A and 200C, and link 200C is ready to slide into link 200A in a direction of the dotted arrow. In FIG. 4E, links 200A and 200C are reconnected, and link 200B is smoothly removed from the watch band.

It can be seen that the above process shows how to remove and install the watch band links through key 240. It is easy to operate, does not require external tools, and is suitable for quickly adjusting the length of the watch band.

It should be noted that the embodiments in this specification are all described in a progressive manner, with each embodiment focusing on the differences from other embodiments. The same and similar parts between the embodiments can be referred to each other. For embodiments of a device, since they are basically similar to embodiments of a method, the description is relatively simple. Please refer to some descriptions of the method embodiments for relevant contents.

Although the embodiments of the present application are disclosed above, the present application is not limited thereto. Any person skilled in the art can make various changes and modifications without departing from the spirit and scope of the present application. Therefore, the protection scope of the present application shall be subject to the scope defined by the claims.

What is claimed is:

1. A detachable link for watch bands, comprising:

an I-piece (210), comprising a first beam (211), a second beam (212) and a third beam (213) connecting the first beam (211) and the second beam (212), and the first beam (211), the second beam (212) and the third beam (213) forming a first recess (214) and a second recess (215) at both sides of the third beam (213), wherein the first recess (214) is configured to receive a middle link of an adjacent detachable link, an inner wall of the first recess (214) is provided with a spring bar hole (216) and a chute (217);

a middle link (220), having a first spring bar passage (221) and a second spring bar passage (222) extending through the middle link (220), wherein the second recess (215) is configured to receive the middle link (220) of the detachable link;

spring bars (230), disposed in the first spring bar passage (221) and the second spring bar passage (222) and elastically stretchable along a length direction thereof; and a key (240), wherein the key is slidably disposed in a key slot (218) defined in the first beam (211) and the second beam (212) respectively and the key is configured to quickly release a connection between the I-piece (210) and the middle link of the adjacent detachable link.

2. The detachable link for watch bands according to claim 1, wherein the key (240) further comprises a first bulge (241) and a second bulge (242), wherein the first bulge (241) is disposed in the spring bar hole (216) of the first recess (214), the second bulge (242) is disposed in a spring bar hole (216) of the second bulge (242), and a length of the first bulge (241) is greater than a length of the second bulge (242).

3. The detachable link for watch bands according to claim 2, wherein one or both ends of one of the spring bars (230) are provided with an elastic element, and when the elastic element is not subjected to an external force, the spring bar (230) configured with the elastic element is in a maximum elongated state.

4. The detachable link for watch bands according to claim 2, wherein a key connecting hole (219) is further provided in the key slot (218), and an I-piece connecting hole (243) configured to fit with the key connecting hole (219) is correspondingly provided in the key (240); the key connecting hole (219), the I-piece connecting hole (243) and a bolt (245) fit with each other so that the key (240) is fixed in the key slot (218) and slides relatively.

5. The detachable link for watch bands according to claim 2, wherein a spring (244) is further disposed between the first bulge (241) and a spring bar (230) of the middle link of the adjacent detachable link, and the spring (244) is used to provide an elastic restoring force so that the key (240) can automatically rebound when released.

6. The detachable link for watch bands according to claim 5, wherein the spring bar hole (216) is configured to receive the spring bar (230) of the middle link of the adjacent detachable link and define a position of the spring bar (230) of the middle link of the adjacent detachable link, the chute (217) is configured to guide movement of the spring bar (230) of the middle link of the adjacent detachable link, and the spring bar (230) of the middle link of the adjacent detachable link is thereby enabled to slide into the spring bar hole (216).

7. The detachable link for watch bands according to claim 6, wherein a depth of the chute (217) gradually decreases in an insertion direction of the middle link (220).

8. A detachable watch band comprising the detachable link according to claim 1.

9. A wristwatch, comprising a dial and a watch band, wherein the watch band comprises the detachable link according to claim 1.

* * * * *